United States Patent [19]

Bogese, II

[11] 4,412,715

[45] Nov. 1, 1983

[54] MODULAR ELECTRICAL PLUG INCORPORATING CONDUCTIVE PATH

[75] Inventor: Stephen B. Bogese, II, Salem, Va.

[73] Assignee: Virginia Patent Development Corp., Roanoke, Va.

[21] Appl. No.: 224,019

[22] Filed: Jan. 12, 1981

[51] Int. Cl.[3] ..... H01R 31/08

[52] U.S. Cl. ..... 339/97 P; 339/19; 339/193 P; 339/222

[58] Field of Search ..... 339/19, 222, 193 P, 339/97 P, 99

[56] References Cited

U.S. PATENT DOCUMENTS

| | | | |
|---|---|---|---|
| 2,544,102 | 3/1951 | Pease . | |
| 2,668,885 | 2/1954 | Gerlat . | |
| 2,844,807 | 7/1958 | McMulkin | 339/193 P |
| 3,813,644 | 5/1974 | Shlesinger, Jr. | 339/19 X |
| 3,840,841 | 10/1974 | Clark . | |
| 3,890,030 | 6/1975 | McDaniel . | |
| 3,954,320 | 5/1976 | Hardesty . | |
| 3,988,639 | 10/1976 | Preiser et al. . | |
| 3,998,514 | 12/1976 | Hardesty . | |
| 4,012,101 | 3/1977 | Damoisiaux et al. . | |
| 4,089,041 | 5/1978 | Lockard | 339/19 X |
| 4,179,178 | 12/1979 | Bachman | 339/222 X |
| 4,281,212 | 7/1981 | Bogese . | |
| 4,314,737 | 2/1982 | Bogese et al. . | |

FOREIGN PATENT DOCUMENTS

| | | | |
|---|---|---|---|
| 2042342 | 8/1970 | Fed. Rep. of Germany . | |
| 2101203 | 7/1971 | Fed. Rep. of Germany | 339/193 P |
| 2360037 | 11/1973 | Fed. Rep. of Germany . | |
| 2345149 | 6/1974 | Fed. Rep. of Germany | 339/193 P |
| 2619677 | 1/1977 | Fed. Rep. of Germany | 339/193 P |

*Primary Examiner*—Howard N. Goldberg

*Attorney, Agent, or Firm*—Saidman, Sterne & Kessler

[57] ABSTRACT

A standard miniature modular connector or plug includes insulaton-piercing contact terminals for terminating a plurality of insulated conductors contained within the housing of the plug. A thin, flexible substrate is positioned within the plug and includes at least one conductive path positioned thereon adjacent to one or more of the insulated conductors. The conductive path is positioned so that at least one of the contact terminals pierces a segment of the path on the substrate to provide an electrical connection thereto. The conductive path or segments may be arranged in any desired fashion, for example, to provide an auxiliary, internal circuit path between two of the contact terminals and/or two of the insulated conductors. Two or more individual multiconductor cables may be terminated in the same plug whereby the conductive path on the substrate may serve as an electrical interconnection between the respective conductors in the two cables. The arrangement may also be utilized to provide a convenient connection between a ground wire and a shielded conductor. In another embodiment, an electrical or electronic component, such as a resistor or an integrated circuit, may be disposed in the conductive path to provide signal modification functions.

44 Claims, 10 Drawing Figures

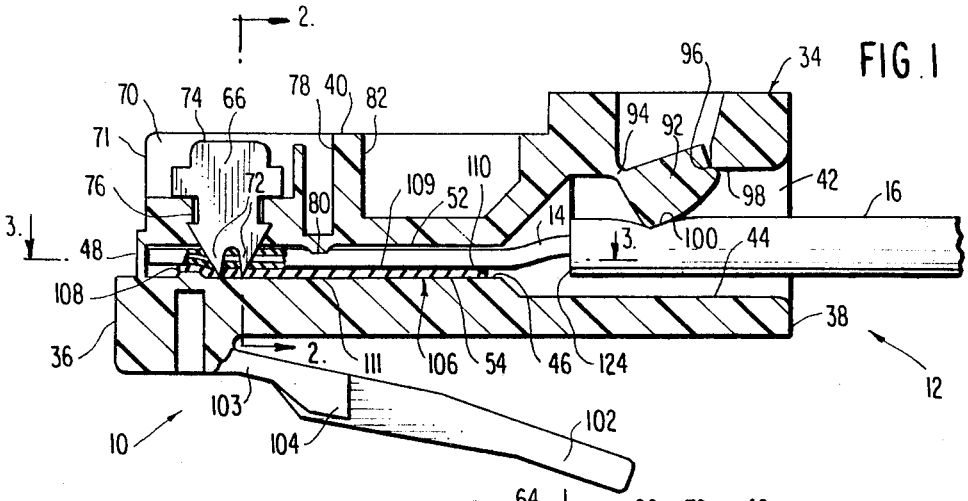
FIG. 1
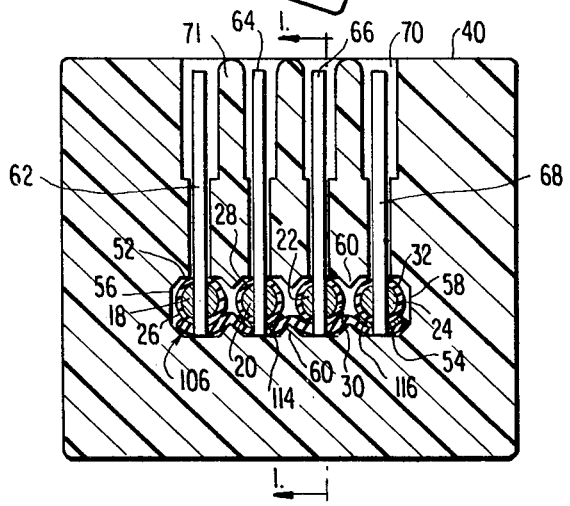
FIG. 2
FIG. 3
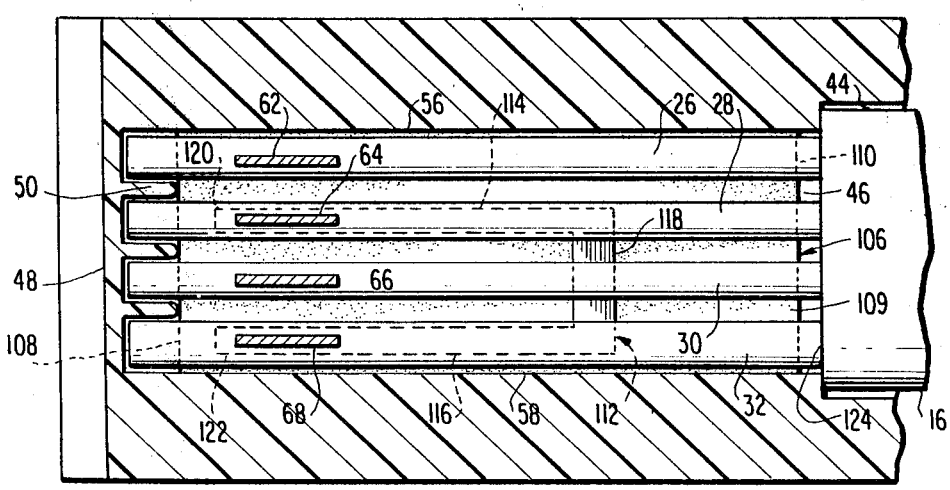

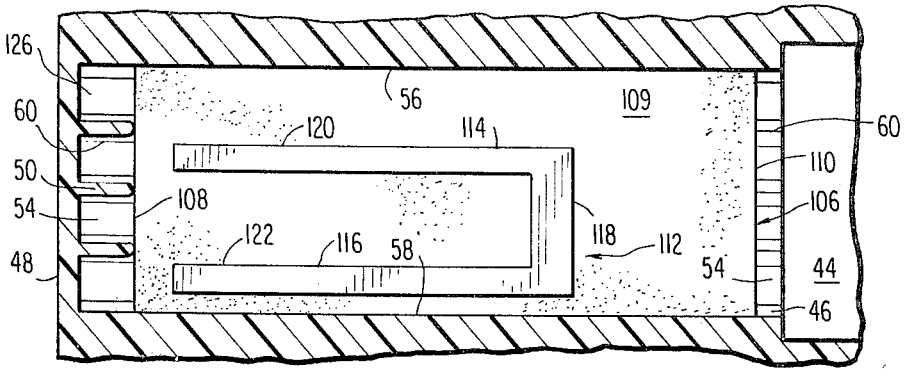
FIG. 4
FIG. 5
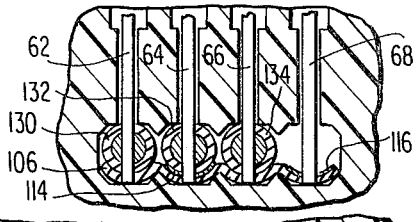
FIG. 6
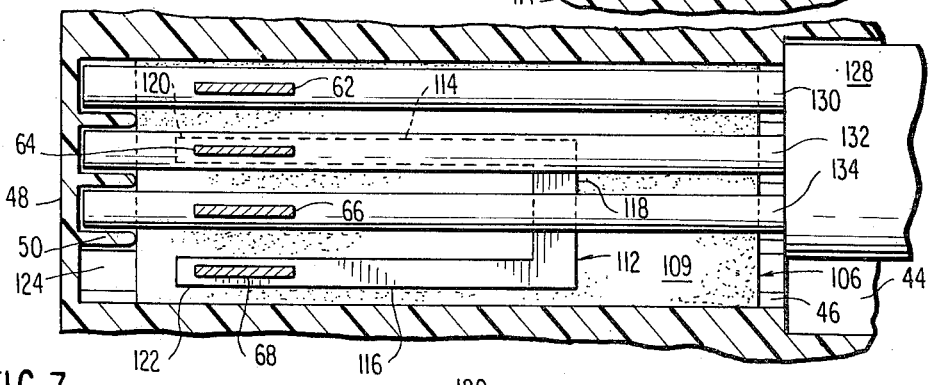
FIG. 7
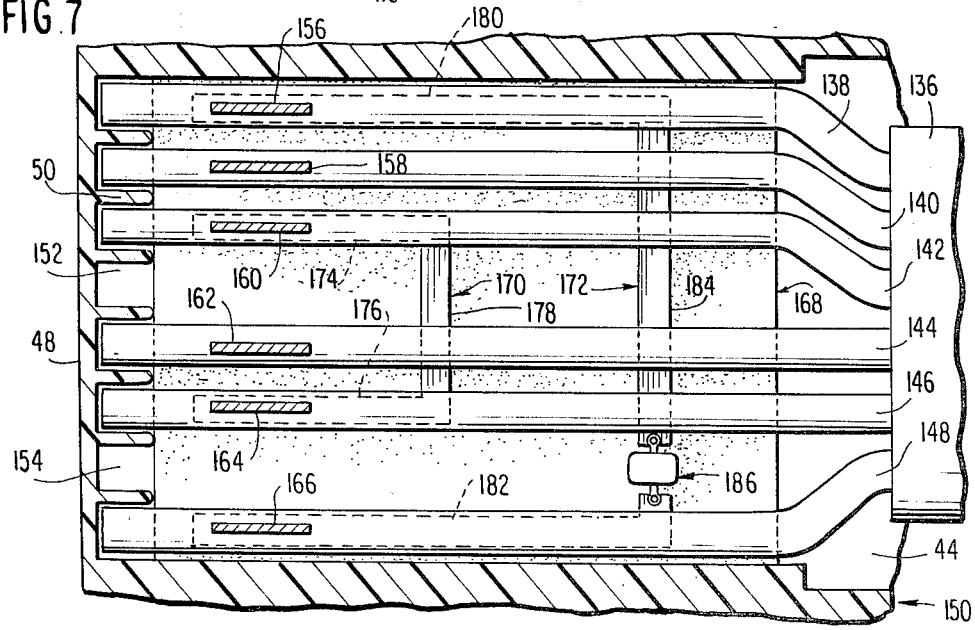

FIG. 8
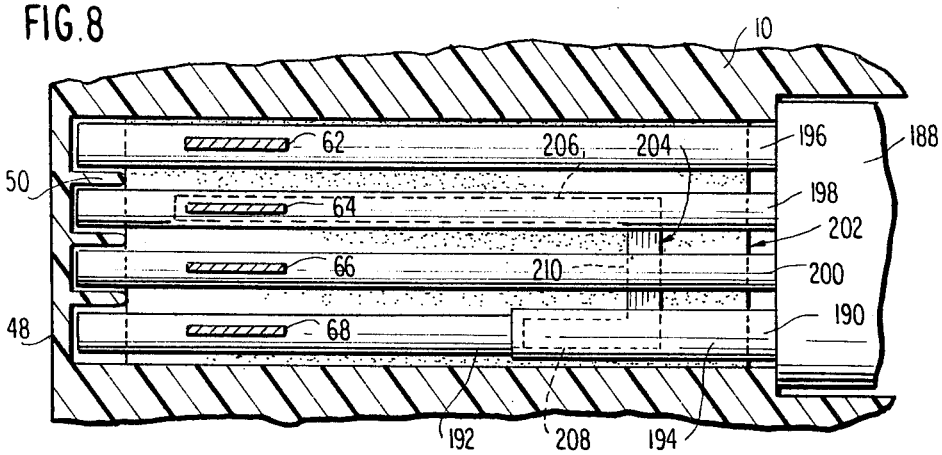
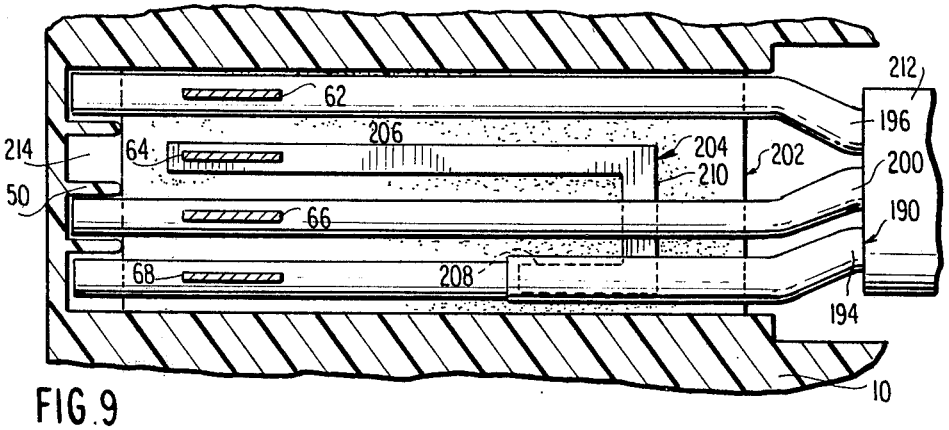
FIG. 9
FIG. 10
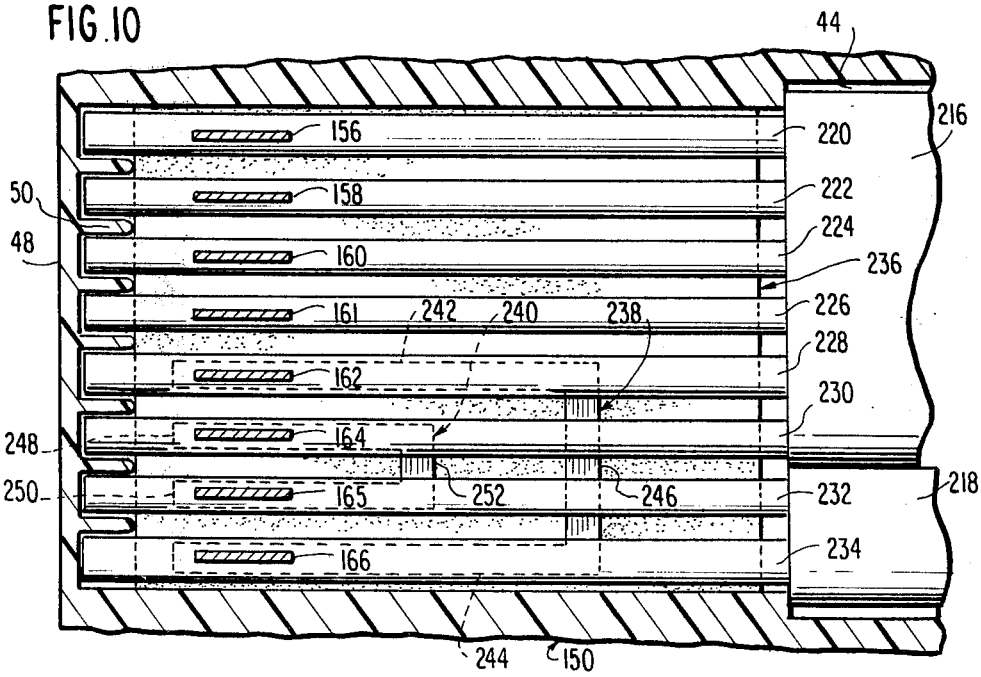

MODULAR ELECTRICAL PLUG INCORPORATING CONDUCTIVE PATH

BACKGROUND OF THE INVENTION

The present invention is related to electrical connectors and, more particularly, to a miniature, modular electrical plug of the type generally described in, for example, U.S. Pat. Nos. 3,954,320 and 3,998,514, both in the name of Hardesty.

The modular plugs exemplified by the above-noted Hardesty patents have become extremely popular in recent years, both in the telephone industry as terminating connectors on telephone cordsets as well as in other, more generalized cable interconnect applications.

The male plugs set forth in the Hardesty patents feature insulation-displacement contact terminals which terminate respective ones of a plurality of insulated conductors in the housing of the plug by piercing the insulation with a pair of tangs. The opposite edges of the contact terminals are arranged linearly on an outside wall of the plug and are adapted to mate with similarly spaced spring contacts of a mating connector or jack which is normally mounted to the equipment to which the electrical connection is desired to be made, such as a telephone handset.

There are certain applications in which a specific resistance needs to be added in a particular line so as to limit the current flow to the equipment. One such application, for example, requires what is referred to as a programming resistor for data modem jacks. Presently, such programming resistors need to be soldered into the female jack or receptacle at the interface point of the telephone system. This requires a serviceman to physically modify a standard receptacle to achieve the desired result.

It would be much more desirable, I have discovered, if the programming resistor could be provided in the plug itself, which would obviate the need for a serviceman to modify each receptacle or female in which such a resistance was desired.

Other special applications have arisen where the presently available plugs and jacks have heretofore required special modification to meet the particular application. For example, in one application, it is desired to have two different conductors in the same cable carry the same signal, so that one input on one end of the cordset can be provided to two different outputs at the connector at the other end of the cordset.

Another special application arises where a cordset is provided with one size of plug (e.g., a four terminal plug) on one end and another size of plug (e.g., a six terminal plug) on the other end. Clearly, a four conductor cable terminated in a six terminal plug will leave two "empty" terminals, and in some instances it is desired to make a connection between one of the "empty" contact terminals and another of the contact terminals which is mated in a normal fashion with one of the conductors. Such an arrangement would permit one conductor to carry signals to or from any of a plurality of contact terminals.

As in the case of the programming resistor mentioned above, in a more generalized application, it would be desirable to be able to modify an input signal from one end of the cordset with either an active or passive electrical or electronic component, and then send the modified or transformed signal down one of the conductors to the other end of the cordset as an output signal. It would clearly be extremely desirable if such signal modification could be accomplished wholly within the plug structure, without requiring externally connected components or auxilliary devices.

In certain applications, it is also desirable to terminate two cables, each having a plurality of conductors, in a single connector at one end, each of the cables having a separate connector at the other end thereof. Further, it may be desirable at the single connector to interconnect one conductor from each cable to a single contact terminal so that one particular signal may be carried by a conductor of each cable. Previously, such a requirement could be met only by external modification of the plug or jack, and it would clearly be desirable if such a modification could be provided internally of the particular plug.

Another special application of such modular plugs occurs where a shielded conductor is desired to be terminated therein. One way of accomplishing this is described in my co-pending application Ser. No. 48,523, filed June 14, 1979, now U.S. Pat. No. 4,281,212, wherein I describe a multi-conductor cable wherein at least one of the conductors includes a thin, metallic shield bonded to the outer insulation thereof. The shield layer is thin enough so that the cable may fit within a standard modular plug. The shield, however, must be connected to a ground wire, which may be accomplished within the cable by placing a ground wire covered by a semiconductor insulation immediately adjacent the shield. If more than one shielded conductor is provided in a particular cable configuration, or if the ground wire of the cable happens not to be positioned immediately adjacent the shielded conductor, or if the cable is not provided at all with a ground wire, some technique is required to provide the ground connection to the shield. It would be desirable if the shields of several non-adjacent shielded conductors could be terminated using only one ground conductor, or, alternatively, if the shields could be terminated without requiring any ground conductors in the cable to keep the size and cost thereof to a minimum.

It is towards providing a solution to the above-noted requirements that the present invention is advanced.

I am aware of the following patent documents, none of which, however, are believed to teach the present invention: U.S. Pat. Nos. 2,544,102; 2,668,885; 3,602,872; 3,840,841; 3,860,316; 3,890,030; 3,954,320; 3,988,639; 4,002,392; 4,012,101; 4,160,575; 4,193,658; 4,202,593; British Pat. No. 4,436,252; and German Pat. Nos. 2,042,342 and 2,360,037.

OBJECTS OF THE INVENTION

It is therefore a primary object of the present invention to provide a novel and unique miniature, modular plug or connector which overcomes the disadvantages and solves the problems noted above with respect to prior art plugs.

A more generalized primary object of the present invention is to provide a miniature modular plug which incorporates means internal to the plug whereby a signal from one conductor or contact terminal may be readily, simply and reliably transferred to another conductor or contact terminal.

Another object of the present invention is to provide a multi-conductor cord or cable terminated at both ends by a connector wherein one input signal at one connector end may be sent to two different outputs at the other connector end.

An additional object of the present invention is to provide a cordset having one size plug at one end thereof and another size plug at the other end thereof wherein a connection may be made internally of the larger connector between a contact terminal in an unfilled conductor position and another contact terminal which pierces another conductor.

A further object of the present invention is to provide a novel connector which permits a signal to be modified or transformed internally of the plug by either an active or passive electrical or electronic component.

A still further object of the present invention is to provide a connector which terminates two separate cables therein, and wherein means are provided for transferring or transforming signals between individual conductors of the two cables internally of the terminating plug.

An additional object of the present invention is to provide a plug having one or more shielded conductors terminated therein with means for permitting grounding of the shielded conductor or conductors using only one ground wire or, alternatively, without requiring an internal ground wire in the cable.

SUMMARY OF THE INVENTION

The foregoing and other objects and features are achieved in accordance with one aspect of the present invention through the provision of an electrical connector which comprises a dielectric housing, conductive wire means positioned in the housing, electrically conductive contact means positioned in the housing for piercing the conductive wire means for permitting an electrical connection to be made thereto externally of the housing, and substrate means positioned in the housing and having an electrically conductive path positioned thereon. More particularly, the conductive wire means comprises a plurality of insulated conductors and the contact means comprises a plurality of insulation-piercing contact terminals, certain of the contact terminals piercing and thereby making electrical connection with an associated one of the insulated conductors.

The substrate means is preferably positioned adjacent the plurality of conductors, and the conductive path on the substrate means includes at least one electrically conductive segment which is adjacent the portion of one of the conductors which is pierced by its associated contact terminal so that the segment is also pierced thereby. The path may further include another conductive segment positioned adjacent the contact piercing portion of another conductor, and an additional conductive segment may connect the first and second segments to complete the circuit path between the two conductors and their respective contact terminals.

In accordance with another aspect of the present invention, the conductive path on the substrate means may further include means in the housing electrically connected to the path for modifying an electrical signal in the path. The signal modifying means may comprise an active or passive electrical or electronic component, or an integrated circuit which may be formed directly on the substrate means.

In accordance with another aspect of the present invention, the plurality of insulated conductors may be fewer than the plurality of contact terminals in the connector housing such that at least one of the contact terminals has no insulated conductors positioned in line therewith. The substrate means may then include a conductive segment positioned adjacent such contact terminals so as to be pierced thereby and the conductive path may include a further segment positioned adjacent one of the other insulated conductors and its associated contact terminal so that an electrical connection may be made between the two contact terminals. This embodiment is also useful wherein one of the plurality of conductors includes a thin, conductive shield bonded to a portion of the insulation of the conductor, the portion having the shield not being pierced by the associated contact terminal. The conductive path may include a segment positioned and in contact with the shield portion of the conductor so that a ground connection may be provided externally by means of the first contact terminal. Alternatively, if the first contact terminal has a ground wire associated therewith, the ground connection may be made internally of the plug via the conductive path on the substrate means.

In accordance with another aspect of the present invention, the substrate means may be provided with more than one separate and distinct conductive path positioned thereon which may be terminated to contact terminals and/or their respective insulated conductors in a manner similar to the first conductive path. Many different permutations and combinations of conductive paths, with or without associated signal processing components, may be provided.

In accordance with another aspect of the present invention, the plurality of electrical conductors emanate from first and second cables which are both terminated in the housing, and the conductive path or paths provided on the substrate means may extend from one conductor in the first cable to another conductor in the second cable.

In accordance with a more specific aspect of the present invention, there is provided an electrical connector for terminating a cable having a plurality of insulated conductors and for making electrical contact external to the connector, which comprises a dielectric housing having a free end adapted to be inserted into a mating jack and a cable-receiving end, the cable-receiving end including a cavity for receiving the cable, the cavity extending longitudinally within the housing towards the free end. A plurality of electrically conductive contact terminals are also positioned within the housing and extend between the cavity for piercing the insulation of and making electrical engagement with the associated conductors of the cable and which include an external surface for making electrical contact with spring contact wires of a mating jack external to the connector. Means are positioned within the cavity adjacent to the insulated conductors for providing an electrically conductive path internal to the connector between at least one of the contact terminals and at least one of the insulated conductors. Such means preferably comprises a thin, flexible substrate having an electrically conductive segment positioned adjacent and pierced by the at least one contact terminal.

BRIEF DESCRIPTION OF THE DRAWINGS

The foregoing and other objects, aspects and features of the present invention will be more fully appreciated as the same becomes better understood when considered in connection with the detailed description of the present invention viewed in conjunction with the accompanying drawings, in which:

FIG. 1 is a longitudinal sectional view taken along line 1—1 of FIG. 2 of a connector plug incorporating a preferred embodiment of the present invention;

FIG. 2 is a cross-sectional view of the embodiment of FIG. 1 and taken along line 2—2 thereof;

FIG. 3 is a sectional view of the preferred embodiment illustrated in FIG. 1 and taken along line 3—3 thereof;

FIG. 4 is a view similar to FIG. 3 but showing the cable removed from the connector housing;

FIG. 5 is a partial cross-sectional view similar to FIG. 2 but showing an alternate embodiment of the present invention;

FIG. 6 is a view similar to FIG. 3 but showing the alternate embodiment of FIG. 5;

FIG. 7 is a sectional view similar to FIG. 3 but illustrating yet another alternate embodiment of the present invention;

FIG. 8 is a view similar to FIG. 3 and illustrating an alternate embodiment of the present invention utilized in conjunction with a shielded conductor configuration;

FIG. 9 is similar to FIG. 8 but illustrates yet another alternate embodiment of the present invention utilized in conjunction with a shielded conductor configuration; and FIG. 10 is a view similar to FIG. 7 and illustrating yet another embodiment of the present invention wherein two cables are terminated in a single connector.

DETAILED DESCRIPTION OF THE PREFFERED EMBODIMENTS

Referring now to the drawings, wherein like reference numerals indicate identical or corresponding parts throughout the several views, and more particularly to FIGS. 1–3 thereof, there is illustrated a first preferred embodiment of the present invention which includes a modular connector or plug indicated generally by reference numeral 10.

Plug 10 is of the same general construction as set forth in U.S. Pat. Nos. 3,954,320 and 3,998,514 to Hardesty, both of which are expressly incorporated herein by reference. More particularly, plug 10 comprises an electrical connector for terminating a cable or cord 12 which includes a plurality of insulated conductors 14 that are positioned side-by-side in a substantially planar array within an outer jacket 16.

The specific embodiment illustrated in FIGS. 1—3 includes a plug 10 for receiving a four-conductor cable 12, although it is clear that larger or smaller plugs and cables can be utilized. Within cable 12 are positioned center conducting wires 18, 20, 22 and 24 each surrounded by respective insulations 26, 28, 30 and 32.

Plug 10 itself preferably includes a one-piece or unipartite rigid dielectric housing indicated generally by reference numeral 34. Housing 34 includes a free end 36 which is adapted to be inserted into a mating jack such as the device described in U.S. Pat. No. 3,850,497 in the name of Krumreich et al, which is expressly incorporated herein by reference. Such a jack typically includes a plurality of side-by-side spring contact members which are placed in a cavity adapted to receive free end 36 of plug 10 for making electrical contact with the plug's contact terminals to be described in greater detail below.

Housing 34 also includes a cord or cable input end 38 as well as a terminal-receiving side 40. The cable input end 38 includes a cord input aperture 42 which opens to a cord-receiving cavity 44 within which jacket 16 of cable 12 is received. Cavity 44 includes a reduced height and width section 46 at the rear portion of housing 34 within which the insulated conductors 26–32 are received after the corresponding portion of jacket 16 has been stripped therefrom.

At the free end 36 of housing 34, cavity section 46 is preferably closed off by an end wall 48 from the inside surface of which extend a plurality of spaced, vertical dividing walls 50 which align and receive the free ends of insulated conductors 26–32 therebetween (FIG. 3).

The cavity section 46 is further defined by opposed internal end walls which include upper wall 52 and lower wall 54 and opposed internal side walls which include side walls 56 and 58. Upper and lower walls 52 and 54 each preferably include a plurality of longitudinally extending molded partitions 60 which form conductor-receiving troughs (see element 126 in FIG. 4) therbetween, each of which is adapted to receive one of the insulated conductors therein. Partitions 60, it is noted, are aligned with vertical dividing walls 50, and together they insure accurate alignment of insulated conductors 26–32 with their respective conductor-piercing contact terminals 62, 64, 66 and 68.

Contact terminals 62–68 are positioned in side-by-side terminal receiving slots 70 which are defined by partitions 71 formed in the terminal receiving side 40 of housing 34.

Each of the contact terminals such as contact terminal 66 of FIG. 1 include conductor-piercing tangs 72 at the lower end thereof and a spring-contact matable surface 74 at the other end thereof which is adapted to come into contact with the similarly-spaced spring contact portion of the mating jack, as described above.

Contact terminals 62–68 are held in place within slot 70 by a press or interference fit within the reduced portions 76 of slot 70.

Housing 34 further includes an opening 78 formed on the terminal receiving side 40 just rearwardly of slots 70. Opening 78 defines a conductor restraining bar 80 at the lower portion thereof which may, if desired, form a strain relief element for the insulated conductors 14 within cavity section 46. Another opening 82 may be formed rearwardly of opening 78 and is provided to reduce the possibility of malformation of the connector housing which might accrue as a result of the large amount of plastic which would otherwise be present in opening 82.

Rearwardly of opening 82 is positioned a jacket anchoring member 92 which is connected to housing 34 by a hinge 94. Member 92 includes a snap-lock ledge 96 which cooperates with the upper wall 98 of cavity 44 such that, upon engagement of member 92 by an appropriate tool, the lower face 100 thereof is forced against jacket 16 to provide strain relief within cavity 44, as is conventional and described in the above-noted Hardesty patent.

Also conventionally provided is a locking tab or latching arm 102 pivotally mounted to housing 34 at 103 and extending downwardly and rearwardly from the lower wall thereof adjacent the free end 36. Latching arm 102 includes spaced shoulders 104 adapted to be secured by similarly spaced shoulder retaining members in the mating jack, as is also conventional.

In accordance with the present invention, a thin, flexible substrate indicated generally by reference numeral 106 is positioned within cavity section 46 adjacent and juxtaposed to the insulated conductors 14. Substrate 106 is preferably positioned below conductors 14 (FIG. 2) adjacent bottom wall 54, but may be positioned above the conductors adjacent the top wall 52, if desired. The substrate 106 in this embodiment is generally rectangular and formed of a thin (e.g., 0.0005 inch–0.002 inch) plastic, such as a polyester film, and is sized so as to be interference or press fit along the edges thereof with side walls 56 and 58 of cavity section 46. The thinness of substrate 106 is dictated by the size of the opening 46 (generally in the range for example of 0.038 inch–0.040 inch) and the outer diameter of insulated conductors 14 (approximately 0.036 inch). The flexibility thereof, which accrues by virtue of its thinness, is necessitated by the presence of partitions 60 in cavity 46 over which the substrate 106 must lie. One end 108 of substrate 106 rests adjacent the ends of walls 50 (see FIG. 3), while the other end 110 may terminate just within cavity section 46 (see FIG. 1), although end 110 could, if desired, extend out into cavity section 44.

Formed on either the upper surface 109 or the bottom surface 111 of substrate 106, or on both surfaces thereof, by any conventional technique is a conductive path indicated generally by reference numeral 112. Conductive path 112 may be designed in any geometry desired for its circuit path functions to be described in greater detail hereinafter. Conductive path 112 is approximately 0.001 inch thick and may comprise metallic particles (e.g., silver, nickel, aluminum, copper or the like) which may be formed on the surface of substrate 106 by any suitable technique. A conductive ink which comprises metallic particles suspended in a binder has been found suitable for the conductive path 112, and a typical conductive ink which may be utilized to form pathway 112 comprises part number E-KOTE 3073 manufactured by Acme Chemicals & Insulation Co.

One technique for forming conductive path 112 comprises utilizing a marking tool having raised surfaces which correspond to the desired conductive path or segment portions. The marking tool is wetted with the conductive ink from a transfer roll and is then stamped onto the substrate and allowed to dry. Application of heat may assist the drying process.

Alternatively, path 112 may be formed by a masking process or a transfer process. In a typical transfer process, for example, the conductive medium is positioned on a carrier strip which is transferred through a transfer press directly onto the substrate. Clearly, many techniques for forming path 112 are within the scope of the present invention.

Substrate 106 together with conductive path 112 is analogous to a printed circuit which provides an auxilliary electrical path or paths internally of plug 10 for the signals in conductors 26–32 and/or contact terminals 62–68. Thus, the necessity for providing connections externally of the plug 10 for such auxilliary circuit paths is avoided.

As shown in FIGS. 1–3, conductive path 112 is formed on the upper surface 109 of substrate 106 and is generally of a U-shaped configuration, although any suitable configuration clearly within the scope of the present invention. Conductive path 112 includes a pair of longitudinal segments 114 and 116 which are connected together by a transverse segment 118. The width of the segments 114, 116 and 118 may be approximately within the range of 0.010 inch–0.030 inch, although other or variable widths may be possible, along with curved paths or the like.

It is noted that longitudinal segment 114 is in alignment with insulated conductor 28, while longitudinal segment 116 is in alignment with insulated conductor 32. Transverse segment 118 therefore extends under insulation 30 (see FIG. 3) to connect segments 114 and 116. For the sake of clarity, substrate 106 is illustrated without the cable or conductors positioned within the housing in FIG. 4.

Reference numerals 120 and 122 respectively represent the tip or end portions of segments 114 and 116. Tip portions 120 and 122 are designed to underlie the position where tangs 72 of contact terminals 64 and 68 pierce their respective insulated conductors 28 and 32. Thus, contact terminals 64 and 68 also pierce the substrate 106 and associated tip portions 120 and 122 of conductive path 112 to establish a conductive electrical network which extends between contact terminal 64, conductor 20, segment 114, segment 118, segment 116, conductor 24 and contact terminal 68. This configuration permits insulated conductors 28 and 32 to carry the same signal either to or from contacts 64 and 68.

In assembly of the present invention, substrate 106 is initially press fit within cavity 46 in the position illustrated in FIG. 4. The cable jacket 16 is then stripped back to expose the ends of conductors 14, whereafter the latter are inserted into cavity 46 above substrate 106. Conductors 14, as stated above, are automatically aligned by partitions 60 and end walls 50, whereafter contact terminals 62–68 are inserted into respective slots 70 until their respective tangs 72 come into contact with bottom wall 54. This insures that tangs 72 pierce both the insulated conductors as well as the underlying substrate 106 and the associated conductive path 112. As stated above, conductive path 112 need not be formed of linear segments, and may extend between two or more contact terminals, two or more conductors, or any combination thereof. More than one conductive path may be provided on the same substrate on either the same or opposite sides thereof.

FIGS. 5 and 6 illustrate an alternate configuration of the present invention wherein housing 34 comprises a four-terminal housing as with the first embodiment, but cable jacket 128 in cavity 44 includes only three insulated conductors 130, 132 and 134. Thus, one of the portions, denoted by reference numeral 124, in the housing 34 has no insulated conductor associated therewith. Substrate 106 and conductive path 112 are identical to the first embodiment, with the result that contact terminal 64 pierces insulated conductor 132 and end 120 of segment 114, while contact terminal 68 pierces only the end portion 122 of segment 116. In this way, conductive path 112 carries the signal from conductor 132 over to contact terminal 68 internally of the connector housing 34. It should be appreciated that this configuration makes it possible for a connector with a smaller number of contacts, thus limiting the number of conductors in the cable, to have a connector with a larger number of contacts at the other end of the cable, and a mechanism for electronic signals to be carried to the extra contacts.

FIG. 7 illustrates a cable jacket 136 having six insulated conductors 138, 140, 142, 144, 146 and 148 terminated in an eight-wire plug 150. The basic structure of plug 150 is substantially the same as the four-wire plug of FIGS. 1–3. It is noted that conductors 138–148 may be positioned in non-adjacent slots, so that conductor receiving slots 152 and 154, for example, are empty. In this embodiment, contact terminals 156, 158, 160, 162, 164 and 166 are positioned so as to pierce respective insulated conductors 138–148 as shown. The flexible substrate 168 positioned within housing 150 in this embodiment includes two separate and electrically isolated conductive paths or networks indicated generally by reference numerals 170 and 172.

Conductive path 170 includes a pair of longitudinally extending segments 174 and 176 which are connected by a transverse segment 178. Segment 174 is positioned under conductor 142 and its associated contact terminal 160, while segment 176 is positioned under conductor 146 and associated contact terminal 164.

The separate conductive path 172 also includes a longitudinal segment 180 which is positioned under conductor 138 and associated contact terminal 156, and a second longitudinal segment 182 positioned under conductor 148 and associated contact terminal 166. A transverse segment 184 connects longitudinal segments 180 and 182 and also may include an electrical or electronic component 186 mounted to substrate 168 and in circuit with transverse segment 184. Component 186 may be an active device, such as a transistor, integrated circuit or even a microprocessor, or a passive device such as a resistor. The component 186 may be connected to segment 184 by any suitable means so that, for example, a signal from contact terminal 156 must travel through component 186 before reaching contact terminal 166. Many circuit configurations, of course, are possible, and are all within the scope of the present invention. For certain environments, the area of the flexible circuit where the component 186 is mounted may be encapsulated with a potting compound such as silicone or epoxy to provide protection against moisture, shock or the like. This may be accomplished for example by filling the connector cavity with the potting compound after termination has been accomplished.

If component 186 comprises an integrated circuit, the present invention contemplates that such a circuit may be directly formed on substrate 168, rather than be encapsulated within a discrete housing as shown in FIG. 7. Further, the substrate 168 may be extended to the right from the position shown in FIG. 7 into cavity 44 to provide additional areas for mounting components thereon. Many circuit configurations are possible for substrate 168, as evidenced by the many different types and designs of printed circuit boards in wide use today. Each, of course, would be tailored to the particular application desired.

Referring now to FIG. 8, there is illustrated a four-wire plug 10 having a four-conductor cable 188 terminated therein. Cable 188 includes a shielded conductor indicated generally by reference numeral 190 which is formed as described in greater detail in my co-pending application Ser. No. 48,523, filed June 14, 1979, now U.S. Pat. No. 4,281,212, which is expressly incorporated herein by reference. Generally, shielded conductor 190 includes an insulated conductor 192 having a thin metallic shield 194 bonded to the outer insulation 192. Note that the shield 194 is terminated short of the corresponding contact terminal 68 for conductor 192 so that the terminal 68 will not pierce the shield.

Also provided in cable 188 are three other insulated conductors 196, 198 and 200. Conductor 198 may comprise a ground wire covered by a semi-conductive or ordinary insulation, or may simply comprise a bare, uninsulated ground wire.

Flexible substrate 202 includes a conductive path indicated by reference numeral 204 having a longitudinal segment 206 which underlies conductor 198 and associated contact terminal 64, and a shortened segment 208 which underlies and is in intimate contact with the shielded portion 194 of insulated conductor 190. A transverse conductive segment 210 connects segments 206 and 208. The effect is such that the conductive path 204 serves to provide a satisfactory ground potential from ground wire 198 via contact terminal 64, segment 206, segment 210 and segment 208 to shield 194. This configuration is useful where the ground wire 198 cannot, for some reason, be located immediately adjacent and in intimate contact with shield 194, as described in my earlier co-pending application.

FIG. 9 illustrates an alternate embodiment of FIG. 8 wherein reference numeral 212 indicates a jacket for a three-wire cable that does not include a ground wire 198, thereby resulting in an "empty" conductor receiving slot 214. In this configuration, which utilizes the same substrate 202 and conductive path 204 as the embodiment of FIG. 8, the ground connection is provided externally to the connector via contact terminal 64 and is transmitted to shield 194 via segments 206, 210 and 208.

Illustrated in FIG. 10 is an alternate embodiment of the present invention wherein two multi-conductor cables 216 and 218 are terminated in the same connector 150. More particularly, an eight-wire plug 150 is illustrated as having a six-wire cable 216 and a two-wire cable 218 held within cavity 44 of plug 150 by means of the same locking bar. Jacket 216 includes six insulated conductors 220, 222, 224, 226, 228 and 230 while jacket 218 includes two insulated conductors 232 and 234. Each of the aforementioned insulated conductors are provided with respective contact terminals 156, 158, 160, 161, 162, 164, 165 and 166.

A flexible substrate 236 is positioned adjacent the insulated conductors and has two separate conductive paths 238 and 240 positioned thereon. Path 238 includes longitudinal segments 242 and 244 connected by a transverse segment 246, while path 240 includes longitudinal segments 248 and 250 connected by a transverse segment 252. This configuration enables a signal from one contact terminal (e.g., contact terminal 162) to be transmitted along one conductor in each of the two cables (e.g., conductors 228 and 234) to possibly different locations or equipment, inasmuch as the cables 216 and 218 are separate and extend to any desired locations. Conductive path 252 provides a similar interconnect between conductors 230 and 232 of cables 216 and 218. Further, this embodiment may include one or more signal modifying electrical or electronic components, as, for example, component 186 of FIG. 7, within the respective conductive paths, or could include more than two cables terminated in the connector.

Obviously, numerous modifications and variations of the present invention are possible in light of the above teachings. It is therefore to be understood that within the scope of the appended claims, the invention may be practiced otherwise than as specifically described herein.

I claim:

1. An electronic connector, which comprises:

a dielectric housing;

conductive wire means positioned in said housing;

electrically conductivve contact means positioned in said housing for piercing said conductive wire means for permitting an electrical connection to be made thereto externally of said housing; and substrate means positioned in said housing and having an electrically conductive path positioned thereon;

wherein said conductive wire means comprises a plurality of insulated conductors and said contact means comprises a plurality of insulation-piercing contact terminals, certain of said terminals piercing and thereby making electrical connection with an associated one of said insulated conductors; and wherein said substrate means is positioned adjacent said plurality of conductors and wherein said path includes at least one electrically conductive segment which is adjacent the portion of one of said conductors which is pierced by its associated contact terminal so that said segment is also pierced thereby.

2. The electrical connector as set forth in claim 1, wherein said path further includes another conductive segment positioned adjacent the contact piercing portion of another of said conductors.

3. The electrical connector as set forth in claim 2, wherein said path further includes an additional conductive segment connecting said at least one segment and said another segment.

4. The electrical connector as set forth in claims 1 or 3, wherein said path further includes means electrically connected thereto in said housing for modifying an electrical signal in said path.

5. The electrical connector as set forth in claim 4, wherein said signal modifying means comprises an electrical component in circuit connection with said path.

6. The electrical connector as set forth in claim 4, wherein said signal modifying means comprises a discrete electronic component in circuit connection with said path.

7. The electrical connector as set forth in claim 4, wherein said signal modifying means comprises an integrated circuit connected electrically to said path.

8. The electrical connector as set forth in claim 7, wherein said integrated circuit is formed on said substrate means.

9. The electrical connector as set forth in claim 1 wherein said plurality of insulated conductors is fewer than said plurality of contact terminals whereby at least one of said contact terminals in said housing has no insulated conductor positioned in line therewith.

10. The electrical connector as set forth in claim 9, wherein said substrate means is positioned adjacent said plurality of conductors and wherein said path includes at least one electrically conductive segment positioned adjacent said at least one contact terminal so as to be pierced thereby.

11. The electrical connector as set forth in claim 10, wherein said path further includes a second electrically conductive segment positioned adjacent one of said insulated conductors and its associated contact terminal so as to be pierced thereby.

12. The electrical connector as set forth in claim 11, wherein said path includes an additional segment connecting said at least one segment and said second segment to establish a conductive path between said at least one contact terminal and said associated contact terminal.

13. The electrical connector as set forth in claim 10, wherein one of said plurality of conductors includes a thin, conductive shield bonded to a portion of the insulation of said conductor, said portion not being pierced by the associated contact terminal.

14. The electrical connector as set forth in claim 13, wherein said path further includes a second electrically conductive segment positioned adjacent and in contact with said portion of said insulation of said one conductor having said shield.

15. The electrical connector as set forth in claim 14, wherein said path includes an additional segment connecting at least one segment and said second segment.

16. The electrical connector as set forth in claim 15, wherein said at least one contact terminal comprises a ground terminal.

17. The electrical connector as set forth in claim 1, wherein one of said plurality of conductors includes a thin, conductive shield bonded to a portion of the insulation of said conductor, said portion not being pierced by the associated contact terminal.

18. The electrical connector as set forth in claim 17, wherein said path further includes a second electrically conductive segment positioned adjacent and in contact with said portion of said insulation of said one conductor having said shield.

19. The electrical connector as set forth in claim 18, wherein said path includes an additional segment connecting said at least one segment and said second segment.

20. The electrical connector as set forth in claim 19, wherein said one conductor comprises a ground wire.

21. The electrical connector as set forth in claim 1, wherein said substrate means further comprises a second electrically conductive path positioned thereon.

22. The electrical connector as set forth in claim 21, wherein said second path includes a first electrically conductive segment which is adjacent the portion of another of said conductors which is pierced by its associated contact terminal so as also to be pierced thereby.

23. The electrical connector as set forth in claim 22, wherein said second path includes a second conductive segment positioned adjacent the contact piercing portion of yet another of said conductors.

24. The electrical connector as set forth in claim 23, wherein said second path further includes an additional conductive segment connecting said first and second segments.

25. The electrical connector as set forth in claims 21 or 24, wherein said second path is physically separate and electrically isolated from the first path.

26. The electrical connector as set forth in claim 21, wherein said plurality of electrical conductors emanate from first and second cables both terminated in said housing, at least one of said paths extending from one conductor in said first cable to another conductor in said second cable.

27. The electrical connector as set forth in claim 26, wherein the other of said paths also extends from a different conductor in said first cable to yet another conductor in said second cable.

28. The electrical connector as set forth in claim 27, wherein one of said paths further includes means electrically connected thereto in said housing for modifying an electrical signal in said one path.

29. The electrical connector as set forth in claim 1, wherein said plurality of electrical conductors emanate from first and second cables both terminated in said housing, said path extending from one conductor in said first cable to another conductor in said second cable.

30. The electrical connector as set forth in claim 29, wherein said path further includes means electrically connected thereto in said housing for modifying an electrical signal in said path.

31. A connector, which comprises:

a dielectric housing;

a plurality of insulated conductors positioned in said housing;

a thin, flexible substrate positioned in said housing adjacent said insulated conductors and having at least one electrically conductive segment thereon; and insulation piercing contact terminal means positioned in said housing for making electrical contact with at least one of said insulated conductors and said segment, whereby electrical connection is made internally of said housing between said contact terminal means and said at least one insulated conductor.

32. An electrical connector for terminating a cable having a plurality of insulated conductors and for making electrical contact external to the connector, which comprises:

a dielectric housing having a free end adapted to be inserted into a mating jack and a cable-receiving end, said cable-receiving end including a cavity for receiving the cable, said cavity extending longitudinally within said housing towards said free end;

a plurality of electrically conductive contact terminals positioned within said housing and extending between said cavity for piercing the insulation of and making electrical engagement with associated conductors of the cable and having an external surface for making electrical contact with spring contact wires of the mating jack external to the connector; and means positioned within said cavity adjacent to the insulated conductors for providing an electrically conductive path internal to the connector between one of said contact terminals and one of said insulated conductors, said means comprising a substrate having an electrically conductive segment positioned adjacent and pierced by said one contact terminal.

33. The electrical connector as set forth in claim 32, wherein said one insulated conductor is also pierced by said one contact terminal.

34. The electrical connector as set forth in claim 33, wherein said segment extends adjacent to and is pierced by a second one of said contact terminals.

35. The electrical connector as set forth in claim 34, wherein said second contact terminal also pierces a second one of said insulated conductors.

36. The electrical connector of claim 32, wherein said one insulated conductor is pierced by a different one of said contact terminals.

37. The electrical connector of claim 36, wherein said segment extends adjacent to and is pierced by said different one of said contact terminals.

38. The electrical connector as set forth in claims 32, 35 or 37, wherein said segment further includes means connected in circuit therewith and in said housing for modifying an electrical signal in said segment.

39. The electrical connector as set forth in claim 38, wherein said signal modifying means comprises an electrical component.

40. The electrical connector as set forth in claim 38, wherein said signal modifying means comprises a discrete electronic component.

41. The electrical connector as set forth in claim 38, wherein said signal modifying means comprises an integrated circuit.

42. The electrical connector as set forth in claim 41, wherein said integrated circuit is formed on said substrate.

43. A connector, which comprises:

a dielectric housing;

a plurality of insulated conductors positioned in said housing;

one of said plurality of conductors including a thin, conductive shield bonded to a portion of the insulation of said conductor;

a thin, flexible substrate positioned in said housing adjacent said insulated conductors and having an electrically conductive path thereon in contact with said shield; and insulation piercing contact terminal means positioned in said housing for making electrical contact with said path whereby electrical connection is made internally of said housing between said contact terminal means and said shield.

44. An electrical connector for terminating a cable having a plurality of insulated conductors and for making electrical contact external to the connector, which comprises:

a dielectric housing having a free end adapted to be inserted into a mating jack and a cable-receiving end, said cable-receiving end including a cavity for receiving the cable, said cavity extending longitudinally within said housing towards said free end;

a plurality of electrically conductive contact terminals positioned within said housing and extending between said cavity for piercing the insulation of and making electrical engagement with associated conductors of the cable and having an external surface for making electrical contact with spring contact wires of the mating jack external to the connector; and means positioned within said cavity adjacent to the insulated conductors for providing an electrically conductive path internal to the connector between two of said contact terminals, said means comprising a thin, flexible substrate having an electrically conductive path positioned adjacent to and pierced by said two contact terminals.

* * * * *